US006340662B1

(12) United States Patent
Millhoff et al.

(10) Patent No.: US 6,340,662 B1
(45) Date of Patent: Jan. 22, 2002

(54) AQUEOUS FOAM REGULATOR EMULSION

(75) Inventors: Juergen Millhoff; Thomas Gassenmeier, both of Duesseldorf; Maria Liphard, Essen; Rene-Andres Artiga González, Duesseldorf; Stefan Hammerstein, Duesseldorf; Ingrid Kraus, Duesseldorf, all of (DE)

(73) Assignee: Henkel Kommanditgesellschaft Auf Aktien (KGaA), Duesseldorf (DE)

( * ) Notice: Subject to any disclaimer, the term of this patent is extended or adjusted under 35 U.S.C. 154(b) by 0 days.

(21) Appl. No.: 09/458,650

(22) Filed: Dec. 10, 1999

(30) Foreign Application Priority Data

Dec. 11, 1998 (DE) ..... 198 57 204

(51) Int. Cl.[7] ..... C11D 1/83; C11D 3/30; C11D 3/32; C11D 3/43

(52) U.S. Cl. ..... 510/417; 510/418; 510/421; 510/423; 510/424; 510/432; 510/466; 510/499; 252/302; 252/351; 252/352; 252/358; 516/55; 516/57; 516/58

(58) Field of Search ..... 510/417, 418, 510/421, 423, 424, 432, 466, 499; 252/302, 351, 352, 358; 516/55, 57, 58

(56) References Cited

U.S. PATENT DOCUMENTS

| | | | | | |
|---|---|---|---|---|---|
| 3,933,672 | A | | 1/1976 | Bartolotta et al. | 252/116 |
| 4,379,755 | A | * | 4/1983 | Yamada et al. | 252/312 |
| 4,419,260 | A | | 12/1983 | Reuter et al. | 252/174.13 |
| 4,504,409 | A | * | 3/1985 | Tsutsumi et al. | 252/351 |
| 5,002,695 | A | | 3/1991 | Schulz et al. | 252/321 |
| 5,516,447 | A | | 5/1996 | Bauer et al. | 252/89.1 |
| 5,656,280 | A | * | 8/1997 | Herb et al. | 424/401 |
| 5,665,687 | A | * | 9/1997 | Khayat et al. | 510/136 |
| 5,683,972 | A | * | 11/1997 | Zocchi | 510/135 |
| 5,702,490 | A | * | 12/1997 | Kneip et al. | 8/94.23 |
| 5,846,798 | A | | 12/1998 | Paatz et al. | 435/187 |
| 5,854,293 | A | * | 12/1998 | Glenn, Jr. | 514/844 |
| 5,990,181 | A | * | 11/1999 | Spyropoulos et al. | 516/118 |
| 6,022,547 | A | * | 2/2000 | Herb et al. | 424/401 |
| 6,066,608 | A | * | 5/2000 | Glenn, Jr. | 510/159 |
| 6,087,317 | A | * | 7/2000 | Gee | 510/417 |
| 6,150,318 | A | * | 11/2000 | Silvester et al. | 510/284 |

FOREIGN PATENT DOCUMENTS

| | | |
|---|---|---|
| DE | 23 38 468 | 2/1974 |
| DE | 31 28 631 | 2/1983 |
| DE | 34 36 194 | 4/1986 |
| DE | 43 29 463 | 3/1995 |
| DE | 44 08 360 | 9/1995 |
| EP | 0 037 026 | 10/1981 |
| EP | 097 867 | 1/1984 |
| EP | 0 309 931 | 4/1989 |
| EP | 0 337 523 | 10/1989 |
| WO | WO 90/13533 | 11/1990 |
| WO | WO 92/11347 | 7/1992 |
| WO | WO 93/04162 | 3/1993 |
| WO | WO 96/26258 | 8/1996 |
| WO | WO 98/09701 | 3/1998 |

OTHER PUBLICATIONS

Derwent Patent Abstract No. 1989–101263 [14].
Derwent Patent Abstract No. 1996–385177 [39](8/96).
Derwent Patent Abstract No. 1974–11333V [07].
Derwent Patent Abstract No. 1983–12662K [06].
Derwent Patent Abstract No. AN 86–100950/16.
Derwent Patent Abstract No. 1990–336011 [45].
Derwent Patent Abstract No. 1993–067797 [09].
Derwent Patent Abstract No. 1992–218091 [27].
Derwent Patent Abstract No. 1995–099570 [14].
Derwent Patent Abstract No. 1995–329047 [43].
Derwent Patent Abstract No. 1998–169860 [16].
The Analyst 87 (1962) 420.

* cited by examiner

*Primary Examiner*—Gregory Delcotto
(74) *Attorney, Agent, or Firm*—Wayne C. Jaeschke; Glenn E. J. Murphy

(57) ABSTRACT

The problem addressed by the invention was to provide a foam regulator system containing silicone and/or paraffin and bis-fatty acid amide which would have a low viscosity, which could be handled at low temperatures and which would have a low percentage content of non-foam-regulating ingredients. This problem was largely solved by an aqueous foam regulator emulsion containing 16% by weight to 70% by weight of active foam regulator based on paraffin wax and/or silicone oil, 2% by weight to 15% by weight of nonionic and/or anionic emulsifier and no more than 80% by weight of water. The foam regulator emulsion is preferably used for the production of partiulate foam regulator granules for use in detergents.

21 Claims, No Drawings

AQUEOUS FOAM REGULATOR EMULSION

BACKGROUND OF THE INVENTION

1. Field of the Invention

This invention relates to a paraffin- and/or silicone-based foam regulator system in the form of an aqueous emulsion, to its use for the production of particulate foam regulators and to a process for their production.

2. Discussion of Related Art

The foam-regulating effect of combinations of paraffins with bis-fatty acid amides in aqueous surfactant-containing systems is known. Thus, European patent EP 0 309 931 B1, for example, describes particulate foam regulators suitable for use in detergents which consist of a water-soluble surfactant-free carrier material and—adsorbed thereto—a siloxane-free defoamer mixture of 5 to 60% by weight of soft and/or hard paraffin, 20 to 90% by weight of microcrystalline paraffin wax with a certain melting range and 5 to 20% by weight of a fine-particle diamide derived from $C_{2-7}$ diamines and $C_{12-22}$ fatty acids. These particulate foam regulators are produced by spray drying of an aqueous slurry containing the carrier material and the defoamer mixture. The defoaming performance of the defoamer mixture is said to be unsatisfactory when it is sprayed onto a particulate detergent.

The use of foam-regulating homogeneous mixtures of nonionic surfactant and a foam regulator system containing paraffin wax and bis-fatty acid amides for improving the production and properties of extruded detergents is known from International patent application WO 96/126258.

DE-OS 23 38 468 relates to a detergent containing a silicone defoamer which is protected against interaction with the detergent ingredients. For its production, aqueous melts containing the silicone defoamer and a carrier material, for example polyglycol, are first spray-dried and the particles obtained are provided with a coating in a fluidized bed of a solid water-soluble shell-forming material. Salts typically used in detergents, more particularly tripolyphosphate or carboxymethyl cellulose, may be used as the coating material. A multistage production process such as this is comparatively expensive on equipment.

DE-OS 31 28 631 describes the production of foam-regulated detergents containing microencapsulated silicone defoamers. The silicone is dispersed in an aqueous solution of a film-forming polymer and the dispersion is delivered to the spray drying tower through a special pipe separately from the other detergent ingredients dissolved or dispersed in water. The two streams are combined in the vicinity of the spray nozzle. Suitable film-forming polymers are, for example, cellulose ethers, starch ethers or synthetic water-soluble polymers and mixtures thereof. The microcapsules are formed spontaneously in the spray nozzle or by preliminary precipitation through the addition of electrolyte salts to the silicone dispersion. The described process is obviously confined to the production of spray-dried detergents and cannot be applied to detergents produced otherwise, for example by granulation, or even to other fields of application.

European patent application EP 097 867 describes a process for the production of microencapsulated defoamer oils by mixing a silicone emulsion with an aqueous solution of carboxymethyl cellulose and precipitating the microcapsules by addition of electrolytes, more particularly polyvalent salts or organic solvents. Considerable difficulties are involved in uniformly distributing the small quantities of silicone microcapsules required for adequate foam suppression in a comparatively large quantity of washing powder.

DE-OS 34 36 194 describes a process for the production of pourable defoamer granules by spray drying of an aqueous defoamer dispersion containing film-forming polymers. To produce granules consisting of 1 to 10% by weight of water-insoluble defoamer, 0.2 to 2% by weight of a mixture of sodium carboxymethyl cellulose and methyl cellulose in a ratio by weight of 80:20 to 40:60, 70 to 90% by weight of inorganic water-soluble or water-dispersible carrier salts, rest water, an aqueous solution containing 0.5 to 8% by weight of the cellulose ether mixture is allowed to swell at a temperature of 15 to 60° C. until the viscosity of the solution is at least 75% of the viscosity of the fully swollen cellulose ether solution, after which the actual defoamer is dispersed in this solution and, after addition of the carrier salts and optionally water, the homogenized dispersion is spray-dried. Organopolysiloxanes, paraffins and mixtures of organopolysiloxanes and paraffins are used as the active defoamers. The active defoamer content is between 1 and 10% by weight and preferably between 3 and 7% by weight. The carrier salt preferably consists of a mixture of sodium silicate, sodium tripolyphosphate and sodium sulfate.

European patent EP 0 337 523 B1 describes a process for the production of powder-form detergents containing at least 5% by weight of anionic surfactant, 20 to 80% by weight of alumosilicate and paraffin wax substantially insoluble in water and anionic and nonionic surfactants which comprises the co-spraying or subsequent spraying of the paraffin onto the preformed detergent particles as a key process step. The paraffin wax may even be used in the form of a mixture with nonionic surfactants.

The variant disclosed in EP 0 337 523 B1, where the paraffin is sprayed onto a preformed powder-form detergent, can only be applied with difficulty if it is desired to use the paraffin wax in combination with a bis-fatty acid amide known to enhance its foam-regulating effect rather than on its own. Bis-fatty acid amides are generally solid at room temperature and have a relatively high melting point, so that they—or their combination with the paraffin—can only be handled in liquid and sprayable form at elevated temperatures of, for example, around 140° C. If the temperature falls below that limit, the pipes and nozzles used are in danger of being blocked through the solidification of the bis-fatty acid amide. Another disadvantage is that the high temperatures of the material sprayed on can cause unwanted interactions with the heat-sensitive ingredients of the detergent. In addition, uniform distribution of the foam regulator system in the detergent is jeopardized if, after spraying on as an extremely hot material, it cools down rapidly after impinging on the detergent powder.

The problem addressed by the present invention was principally to develop a liquid formulation of a foam regulator system containing silicone oil and/or paraffin and bis-fatty acid amide which would have a low viscosity, which could be handled at low temperatures and which would have a low percentage content of non-foam-regulating ingredients. In addition, only a slight reduction in defoaming performance would occur both during production and in storage and during the ultimate further processing of the liquid composition to particulate products.

DESCRIPTION OF THE INVENTION

The present invention, which solves this problem, relates to an aqueous foam regulator emulsion containing 16% by weight to 70% by weight of active foam regulator based on paraffin wax and/or silicone oil, 2% by weight to 15% by weight of nonionic and/or anionic emulsifier and no more than 80% by weight of water. A paraffin wax base in the context of the present invention is understood in particular to be a combination of paraffin wax and bis-fatty acid amide. A foam regulator emulsion according to the invention preferably contains 15% by weight to 60% by weight and, more particularly, 30% by weight to 50% by weight of paraffin wax or a mixture of paraffin wax and silicone oil, 1% by weight to 10% by weight and, more particularly, 3% by weight to 8% by weight of bis-fatty acid amide derived from $C_{2-7}$ diamines and $C_{12-22}$ fatty acids, 2% by weight to 15% by weight and, more particularly, 3% by weight to 10% by weight of nonionic and/or anionic emulsifier and no more than 80% by weight, preferably no more than 60% by weight and, in particularly preferred embodiment, 20% by weight to 50% by weight of water.

The present invention also relates to the use of such emulsions for the foam regulation of aqueous systems with a tendency to foam, more particularly detergent liquors, and to their use for the production of particulate detergents by spraying onto granular particles which contain all or at least some of the detergent ingredients solid at room temperature.

The present invention also relates to a process for the production of particulate foam regulator granules by spraying the aqueous emulsion mentioned onto a solid carrier material, optionally followed by a drying step, or by spray drying an aqueous slurry obtained by mixing the foam regulator emulsion with solid carrier material and optionally water.

A foam regulator emulsion according to the invention containing paraffin wax is preferably prepared by melting the paraffin wax and the bis-fatty acid amide in the presence of the emulsifier, optionally cooling the melt to at most about 100° C. and stirring it into water. If mixtures of nonionic emulsifier and anionic emulsifier are used, the nonionic emulsifier is preferably incorporated in the melt of paraffin wax and bis-fatty acid amide, as described above, and the anionic emulsifier is added to the water before the melt is stirred in and not to the melt. If the paraffin wax and the bis-fatty acid amide are used in molten, uncooled form, cold water with a temperature corresponding at most to room temperature is preferably used. If the melt is cooled to a temperature of at most about 100° C. before being stirred into water, water with a temperature of around 50° C. to 80° C. is preferably used. Standard mixers are normally sufficient for uniformly distributing all the components and hence for producing the aqueous emulsion according to the invention. There is generally no need to use high-speed mixers or homogenizers (for example of the Ultra Turrax® type). Silicone oil may be additionally incorporated at this stage of the process. If foam regulator emulsions containing silicone oil as sole active foam regulator or in a relatively large quantity compared with the quantity of paraffin wax are to be produced, the silicone oil is preferably first mixed with the nonionic and/or anionic emulsifier, part of the quantity of water is added with stirring so that an emulsion of the water-in-silicone type is formed, more water is then added until inversion of the emulsion occurs and, after intensive stirring, the remaining water is added. The emulsion obtainable in this way may have a partly multiple character, in other words droplets of the original core emulsion of the water-in-silicone type may also be present in the outer water phase.

The foam regulator emulsions obtainable in accordance with the invention are stable and preferably have viscosities at 60° C. below 2500 mPa·s and, more preferably, in the range from 100 mPa·s to 500 mPa·s, as measured for example with a Brookfield rotational viscosimeter (spindle No. 2, 5 r.p.m.).

The paraffin waxes suitable for use in accordance with the invention are generally complex mixtures without a clear-cut melting point. For characterization purposes, their melting range is normally determined by differential thermoanalysis (DTA), as described in "The Analyst" 87 (1962), 420, and/or their solidification point is determined. This is understood to be the temperature at which the wax changes from the liquid into the solid state through slow cooling. According to the invention, both paraffins completely liquid at room temperature, i.e. those with a solidification point below 25° C., and paraffins solid at room temperature may be used. The paraffin wax is preferably solid at room temperature and is present in completely liquid form at 100° C. For example, it is possible to use the paraffin wax mixtures known from European patent application EP 0 309 931 of, for example, 26% by weight to 49% by weight of microcrystalline paraffin wax with a solidification point of 62° C. to 90° C., 20% by weight to 49% by weight of hard paraffin with a solidification point of 42° C. to 56° C. and 2% by weight to 25% by weight of soft paraffin with a solidification point of 35° C. to 40° C. Paraffins or paraffin mixtures which solidify at 30° C. to 90° C. are preferably used. It is important in this connection to bear in mind the fact that even paraffin wax mixtures that appear solid at room temperature can contain various amounts of liquid paraffin. In the paraffin waxes suitable for use in accordance with the invention, the liquid component at 40° C. is high without ever reaching 100% at that temperature. Preferred paraffin wax mixtures have a liquid component at 40° C. of at least 50% by weight and preferably from 55% by weight to 80% by weight and a liquid component at 60° C. of at least 90% by weight. In particularly preferred paraffin wax mixtures, the temperature at which a liquid component of 100% by weight of the paraffin wax is reached is still below 85° C.and, more particularly, between 75° C. and 82° C. In addition, it is important to bear in mind that the paraffins should not contain any volatile components. Preferred paraffin waxes contain less than 1% by weight and, in particular, less than 0.5% by weight of components volatile at 110° C./normal pressure. Paraffin waxes suitable for use in accordance with the invention may be obtained, for example, under the name of Lunaflex® from Fuller and under the name of Deawax® from DEA Mineralöl AG. Instead of the paraffin wax, it is also possible to use foam-regulating silicone oil or mixtures of paraffin wax with foam-regulating silicone oil. In the context of the present invention, any reference to silicone oil always includes its mixture with fine-particle fillers, for example hydrophilic or hydrophobic silicon dioxide, so-called highly disperse silica. Pyrogenic or precipitated, more particularly hydrophobicized, silicon dioxide with a surface of at least 50 $m^2/g$—commercially obtainable, for example under the names of Aerosil® and Sipernat®—is particularly preferred. In one embodiment of the invention, silicone oil, for example polydimethyl siloxane, is preferably present in mixtures of paraffin wax and silicone oil in such quantities that the foam regulator emulsion prepared therefrom has a silicone oil content of 0.1% by weight to 10% by weight and, more particularly, 1% by weight to 5% by weight. In another preferred embodiment of the invention, the foam regulator emulsion contains a mixture of silicone oil and paraffin wax in a ratio by weight of 2:1 to 1:100 and, more particularly, 1:1 to 1:10. A particularly preferred foam regulator emulsion contains 10% by weight to 40% by weight and, more particularly, 15% by weight to 35% by weight of silicone oil and 50% by weight to 80% by weight of water.

If the foam regulator emulsion according to the invention contains paraffin wax, a second key component of the defoamer system is formed from bis-fatty acid amides. Bis-amides derived from $C_{12-22}$ and preferably $C_{14-18}$ fatty acids and from $C_{2-7}$ alkylenediamines are suitable. Suitable fatty acids are lauric acid, myristic acid, stearic acid, arachic acid and behenic acid and the mixtures thereof obtainable from natural fats or hydrogenated oils, such as tallow or hydrogenated palm oil. Suitable diamines are, for example, ethylenediamine, 1,3-propylenediamine, tetramethylenediamine, pentamethylenediamine, hexamethylenediamine, p-phenylenediamine and toluylenediamine. Preferred diamines are ethylene-diamine and hexamethylenediamine. Particularly preferred bis-amides are bis-myristoyl ethylenediamine, bis-palmitoyl ethylenediamine, bis-stearoyl ethylenediamine and mixtures thereof and the corresponding derivatives of hexamethylenediamine.

In the context of the invention, nonionic emulsifiers, which may be used in emulsions according to the invention, are understood in particular to be the alkoxylates, preferably the ethoxylates and/or propoxylates, of alcohols, alkylamines, vicinal diols, carboxylic acids and/or carboxylic acid amides containing $C_{8-22}$ and preferably $C_{12-18}$ alkyl groups. The average degree of alkoxylation of these compounds is generally from 1 to 10 and preferably from 2 to 5. They may be prepared in known manner by reaction with the corresponding alkylene oxides. Products obtainable by alkoxylation of fatty acid alkyl esters containing 1 to 4 carbon atoms in the ester moiety using the process according to International patent application WO 90/13533 may also be used. Suitable alcohol alkoxylates include the ethoxylates and/or propoxylates of linear or branched alcohols containing 8 to 22 and preferably 12 to 18 carbon atoms. The derivatives of the fatty alcohols are particularly suitable although their branched-chain isomers may also be used for the production of suitable alkoxylates. Accordingly, the ethoxylates of primary alcohols containing linear dodecyl, tetradecyl, hexadecyl and octadecyl radicals and mixtures thereof are particularly suitable. Corresponding alkoxylates of mono- or polyunsaturated fatty alcohols, including for example oleyl alcohol, elaidyl alcohol, linoleyl alcohol, linolenyl alcohol, gadoleyl alcohol and erucyl alcohol, may also be used. Esters or partial esters of carboxylic acids with a corresponding carbon chain length with polyols, such as glycerol or oligoglycerol, may also be used. Preferred anionic emulsifiers are alkali metal salts of alkyl benzenesulfonic acids containing 9 to 13 carbon atoms in the alkyl group, more particularly sodium dodecyl benzenesulfonate. In addition to these emulsifiers, small quantities—optionally up to 4% by weight—of anionic and/or nonionic cellulose ethers, such as carboxymethyl cellulose and/or hydroxyethyl cellulose, may also be present.

It is essential to use a homogeneous mixture of foam regulator system and in particular nonionic emulsifier. This may advantageously be achieved simply by melting the bis-amide solid at room temperature in the presence of the paraffin and the emulsifier, preferably with stirring or homogenization. If the bis-amide is not used as such, but rather in the form of a mixture with the paraffin, heating beyond the melting point of the bisamide is generally not necessary because a solution of the bis-amide in the paraffin is generally formed at lower temperatures. After it has been formed, preferably at temperatures of 60° C. to 150° C. and more preferably 80° C. to 150° C., the mixture of defoamer system and emulsifier is mixed with the water, optionally after cooling, an emulsifier, more particularly an anionic emulsifier, optionally having been added to the water beforehand. In this case, the concentration of anionic emulsifier in water is preferably between 5% by weight and 15% by weight.

The foam regulator system thus obtainable is stable in storage at room temperature and may be used as such in liquid detergents simply by addition to and mixing with the other components of the detergent. The foam regulator emulsion according to the invention may also be used for the foam regulation or deaeration of, in particular, aqueous liquid detergents during their production and/or packaging. However, the free-flowing emulsion is preferably applied to a solid detergent ingredient and/or one made up in solid form, for example to inorganic builder particles, so that the active foam regulators may readily be incorporated in particulate detergents.

If the particulate detergent as a whole is to be impregnated with the defoamer emulsion, a quantity of preferably 0.1% by weight to 5% by weight and more preferably 0.25% by weight to 3% by weight of defoamer emulsion is applied to the detergent particles. If so-called foam regulator granules are to be produced, i.e. the active foam regulators are not applied to the detergent as a whole, but only to part of the solid components typically present therein (hereinafter referred to as carrier materials) and the foam regulator granules are subsequently added to and mixed with the other solid components of the detergent, a quantity of preferably 3% by weight to 60% by weight and, more preferably, 15% by weight to 45% by weight of defoamer emulsion is applied. After the aqueous defoamer emulsion has been sprayed on, a drying step, for example carried out in a conventional fluidized bed dryer, may be added on or the defoamer emulsion is applied with simultaneous drying, for example in a fluidized bed. If the defoamer is to be made up in particle form by spray drying of an aqueous slurry containing the defoamer emulsion and the solid detergent ingredients or carrier materials, the quantity ranges mentioned above apply accordingly.

The solid detergent ingredients and/or those made up in solid form, to which or to at least one of which the emulsion according to the invention is applied to produce particulate products, include typical powders produced by spray drying of aqueous slurries of their ingredients, solid bleaching agents, bleach activators made up in solid form, anionic surfactant compounds not produced by conventional spray drying according to International patent application WO 93/04162 with a content of more than 80% by weight and, in particular, more than 90% by weight of alkyl sulfate with alkyl chain lengths of $C_{12}$ to $C_{18}$, the rest consisting essentially of inorganic salts and water, powder-form polycarboxylate co-builders, for example alkali metal citrate, solid inorganic builders, such as zeolite A, zeolite P and crystalline layer silicates, and other inorganic salts, such as alkali metal sulfate, alkali metal carbonate, alkali metal hydrogen carbonate and alkali metal silicate and mixtures thereof. The carrier material preferably contains a combination of alkali metal hydrogen carbonate and alkali metal carbonate in a ratio by weight of preferably 99:1 to 10:90 and more preferably 95:5 to 50:50. The preferred alkali metal is sodium.

A spray drying product which is used in a preferred variant of the process according to the invention and which is to be impregnated with the foam regulator emulsion preferably contains 25% by weight to 65% by weight and more preferably 30% by weight to 60% by weight of inorganic builder and 7.5% by weight to 40% by weight and more particularly 10% by weight to 30% by weight of anionic surfactant, more particularly synthetic anionic surfactant of the sulfate and/or sulfonate type. The balance to 100% by weight consists of typical ingredients of spray-dried detergents, more particularly water, preferably in quantities of up to 20% by weight and more preferably in quantities of 8% by weight to 18% by weight, organic co-builder, preferably in quantities of up to 8% by weight and more preferably in quantities of 3% by weight to 6.5% by weight, redeposition inhibitors which are preferably present in spray drying products intended for the production of detergents in quantities of up to 5% by weight and more particularly from 1.5% by weight to 3% by weight and inorganic water-soluble salts, for example alkali metal sulfates and/or carbonates, which are preferably present in quantities of up to 20% by weight and more particularly in quantities of 2% by weight to 12% by weight.

The other detergent ingredients, which may be used as carrier material in the making up of the foam regulator emulsion in particulate form, include solid oxygen-based bleaching agents, for example alkali metal percarbonates or alkali metal perborates which may be present as so-called monohydrates or tetrahydrates, bleach activators made up in powder form, for example the tetraacetyl ethylenediamine granules produced by the process according to European patent EP 0 037 026, concentrated anionic surfactant compounds made up in solid form, for example the alkyl sulfate compound produced by the process according to International patent application WO 93/04162, enzymes present in granular form, for example the enzyme extrudate produced by the process according to International patent application WO 92/11347 or the multi-enzyme granules produced by the process according to German patent application DE 43 29 463 and/or a soil-release agent made up in powder form, for example by the process according to German patent application DE 44 08 360.

In a preferred variant of the process for producing particulate foam regulator granules, granulation is carried out in a granulation mixer largely as described in International patent application WO 98/09701, i.e. a quantity of 50 to 100 parts by weight and, more particularly, 60 to 85 parts by weight of inorganic carrier salt preferably containing alkali metal sulfate, alkali metal carbonate and/or alkali metal hydrogen carbonate is intensively mixed, optionally with a quantity of up to 5 parts by weight and more particularly 1 to 3 parts by weight of an anionic and/or nonionic cellulose ether, a quantity of 1 to 10 parts by weight and more particularly 2 to 8 parts by weight of an aqueous alkali metal silicate and/or polymeric polycarboxylate solution is added while granulation is continued and, finally, 10 parts by weight of the foam regulator emulsion optionally heated to a temperature of 70° C. to 180° C. are added.

EXAMPLES

Example 1

Aqueous emulsions E1, E2, E3 and E4 were prepared from the ingredients indicated—along with the quantities used—in the following Table. To this end, the paraffin wax (or the mixture of paraffin wax and silicone oil) and the bis-stearic acid ethylenediamide were melted together with emulsifier I or II by heating to a temperature of about 150° C. and stirred into cold water (E1 and E4) or into an aqueous solution of emulsifier III (E2 and E3).

TABLE 1 composition of the foam regulator emulsions [% by weight]

| Emulsion | E1 | E2 | E3 | E4 |
|---|---|---|---|---|
| Paraffin wax[a)] | 44 | 44 | 40 | 41 |
| Silicone oil | — | — | 4.5 | 3.5 |
| Bis-stearic acid ethylenediamide | 6 | 6 | 6 | 6 |
| Emulsifier I[b)] | 5 | 5 | 5 | — |
| Emulsifier II[c)] | — | 4 | — | 7.5 |
| Emulsifier III[d)] | — | 4 | 5.5 | — |
| Water | | to 100 | | |

[a)]Solidification point according to DIN ISO 2207 45° C., liquid component at 40° C. ca. 66% by weight, at 60° C. ca. 96% (Lunaflex ®, a product of DEA)
[b)]3x-ethoxylated $C_{12/14}$ fatty alcohol, a product of Cognis Deutschland GmbH
[c)]2:1 mixture of 7x-ethoxylated $C_{12/16}$ fatty alcohol, a product of Cognis Deutschland GmbH, and triglycerol diisostearate, a product of Cognis Deutschland GmbH
[d)]Sodium dodecyl benzenesulfonate The foam regulator emulsions thus obtained were applied in quantities of 30% by weight to an inorganic particulate carrier material by the method described in WO 98/09701. The foam regulator granules thus obtained were added in a quantity of 1% by weight to a defoamer-free particulate detergent which produced a defoaming performance at washing temperatures of 40° C., 60° C. and 90° C. in no way inferior to that of conventionally produced defoamer granules.

Example 2

The quantities of silicone oil and emulsifier shown in the following Table were stirred at room temperature until a homogeneous highly viscous paste was formed. A small quantity of water was added with intensive stirring. An emulsion of the water-in-silicone type was formed. When more water was added in substantially the same quantity, based on the mixture of silicone oil and emulsifier, inversion of the emulsion occurred. The emulsion was then intensively stirred for about 5 minutes, after which the remaining water was added over a period of 10 minutes with continuous stirring.

TABLE 2 composition of the foam regulator emulsions [% by weight]

| Emulsion | E5 |
|---|---|
| Silicone oil | 25 |
| Emulsifier IV[e)] | 2.5 |
| Emulsifier V[f)] | 1.25 |
| Water | to 100 |

[e)]Poly(12-hydroxystearic acid) polyglycerol ester (Dehymuls ® PGPH, a product of Cognis Deutschland GmbH)
[f)]Na $C_{12/18}$ alkyl sulfate

What is claimed is:

1. An aqueous foam regulator emulsion comprising:

a) 16 to 70 percent by weight of an active foam regulator comprising a mixture of a paraffin wax and a silicone oil in a weight ratio of 1:2 to 100:1;

b) 2 to 15 percent by weight of an nonionic and/or anionic emulsifier;

c) less than 80 percent by weight of water; and d) 1 to 10 percent by weight of bis-fatty acid amide derived from $C_{2-7}$ diamines and $C_{12-22}$ fatty acids.

2. The aqueous foam regulator emulsion of claim 1 comprising as said active foam regulator:

a) 15 to 60 percent by weight of paraffin wax, silicone oil, or a mixture thereof.

3. The aqueous foam regulator emulsion of claim 1 comprising 30 to 50 percent by weight of said active foam regulator.

4. The aqueous foam regulator emulsion of claim 1 wherein said active foam regulator comprises a mixture of silicone oil and paraffin wax in a ratio by weight of 1:1 to 1:10.

5. The aqueous foam regulator emulsion of claim 1 wherein said paraffin wax is solid at room temperature and completely liquid at 100° C.

6. The aqueous foam regulator emulsion of claim 1 wherein said paraffin wax has a liquid component at 40° C. of at least 50 percent by weight, and a liquid component at 60° C. of at least 90 percent by weight.

7. The aqueous foam regulator emulsion of claim 6 wherein said paraffin wax has a liquid component at 40° C. of 55 to 80 percent by weight.

8. The aqueous foam regulator emulsion of claim 2 comprising 3 to 8 percent by weight of bis-fatty acid amide derived from $C_{2-7}$ diamines and $C_{12-22}$ fatty acids.

9. The aqueous foam regulator emulsion of claim 1 comprising 10 to 40 percent by weight of silicone oil, and 50 to 80 percent by weight of water.

10. The aqueous foam regulator emulsion of claim 9 comprising 15 to 35 percent by weight of silicone oil.

11. The aqueous foam regulator emulsion of claim 1 comprising 0.1 to 10 by weight silicone oil.

12. The aqueous foam regulator emulsion of claim 11 comprising 1 to 5 by weight silicone oil.

13. The aqueous foam regulator emulsion of claim 1 comprising 3 to 10 percent by weight of nonionic and/or anionic emulsifier.

14. The aqueous foam regulator emulsion of claim 1 wherein said nonionic emulsifier comprises an alkoxylate of an alcohol, alkylamine, vicinal diol, carboxylic acid amide, or mixtures thereof, and wherein said alkoxylate comprises $C_{8-22}$ alkyl groups and has an average degree of alkoxylation of 1 to 10.

15. The aqueous foam regulator emulsion of claim 14 wherein said alkoxylate comprises $C_{12-18}$ alkyl groups.

16. The aqueous foam regulator emulsion of claim 14 wherein said alkoxylate has an average degree of alkoxylation of 2 to 5.

17. The aqueous foam regulator emulsion of claim 1 wherein said anionic emulsifier comprises an alkali metal salt of alkyl benzenesulfonic acid containing 9 to 13 carbon atoms in the alkyl group.

18. The aqueous foam regulator emulsion of claim 1 comprising no more than 60 percent by weight of water.

19. The aqueous foam regulator emulsion of claim 18 comprising 20 to 50 percent by weight of water.

20. The aqueous foam regulator emulsion of claim 1 having a viscosity at 60° C. of below 2500 mpa·s.

21. The aqueous foam regulator emulsion of claim 20 having a viscosity at 60° C. of from 100 mpa·s to 500 mpa·s.

* * * * *